US005337440A

United States Patent [19]

Vosbikian et al.

[11] Patent Number: 5,337,440

[45] Date of Patent: Aug. 16, 1994

[54] TOOL HEAD BRACE

[75] Inventors: Peter S. Vosbikian, Moorestown, N.J.; Haig Vartanian, Cheltenham, Pa.

[73] Assignee: Quickie Manufacturing Corporation, Cinnaminson, N.J.

[21] Appl. No.: 2,927

[22] Filed: Jan. 11, 1993

[51] Int. Cl.[5] ..... A46B 15/00

[52] U.S. Cl. ..... 15/143.1; 15/175; 16/113

[58] Field of Search ..... 15/143.1, 145, 175, 15/159.1; 403/362, 389, 196; 16/113, 114 R; 248/519, 523, 431; 294/57

[56] References Cited

U.S. PATENT DOCUMENTS

| | | | |
|---|---|---|---|
| 1,028,062 | 5/1912 | Phare et la. | 15/143.1 |
| 1,124,283 | 1/1915 | Brophy | 15/145 |
| 1,134,076 | 3/1915 | Hipkins | 16/114 |
| 3,188,671 | 6/1965 | Kane | 15/145 |
| 3,315,296 | 4/1967 | Richardson | 15/159.1 |
| 3,876,318 | 4/1975 | Crispell | 403/362 |
| 4,239,413 | 12/1980 | Wludyka | 15/175 |
| 5,096,327 | 3/1992 | Ruland | 403/362 |

FOREIGN PATENT DOCUMENTS

| | | | |
|---|---|---|---|
| 260056 | 7/1949 | Switzerland | 15/175 |

*Primary Examiner*—Mark Rosenbaum
*Assistant Examiner*—David P. Bryant
*Attorney, Agent, or Firm*—Eckert Seamans Cherin & Mellott

[57] ABSTRACT

A brace for a tool having an elongated handle and a working head disposed perpendicularly to the handle, such as a push broom, has a slidable collar and a pair of buttress rods. The working head is provided with a pair of holes on a top side, each hole being spaced from a center of the tool head on opposite ends of the tool head with respect to the center. The buttress rods are thick wires, each have a downward facing prong inclined for insertion into each respective hole for engaging in tension and compression. Each buttress rod generally defines a leg portion angled upwards from the prong and tool head towards the handle. An upper end of each buttress likewise has a prong or arm angled so as to lay flat adjacent the broom handle, parallel to a longitudinal axis of the handle and also engaging in tension and compression. The upper prongs fit into oppositely disposed channels of a collar fixed axially on the handle. A thumb screw or the like passes through a threaded bore radially disposed through the collar body is used to fix the collar in place on the tool handle, axially and against rotation.

10 Claims, 3 Drawing Sheets

TOOL HEAD BRACE

BACKGROUND OF THE INVENTION

1. Field of the Invention

The invention relates to a brace for a tool head, in particular to a brace for a tool having an elongated handle and a working head elongated perpendicular to the handle. A push broom is an example of such a tool. Typically, the elongated handle terminates in a threaded portion and is screwed into a reciprocal threaded socket in the working head for attachment of the handle to the head.

2. Prior Art

A threaded attachment of a handle and a broom head is prone to loosen during normal use of the broom, for example due to striking of the head against obstructions, and particularly where an impact is spaced from the axis of the handle, e.g., at the lateral end of the broom head. Furthermore, the broom-head is typically made of wood. Often the threads become broken, especially during heavy use of the broom, because wooden threads do not provide an inherently strong connection. Inasmuch as the threads in the head must be coarse to be formed in wood, and there is usually room for only a few turns, the threads wear and the connection loosens. Alternative connections for the handle to the head include holding the head against the handle by friction, such as when using a clamp to clamp the handle to the head, or by a pin fastening transversely through the handle and a socket formed in the head.

It is frequently advantageous for tools such as push brooms to have quite large working heads, for covering a wide swath. The broom head may contain a great number of heavy-duty bristles, affixed in or to a downward facing planar surface of the broom head. The handle, on the other hand, is cylindrical in shape and generally relatively thin, e.g., one inch or 2.5cm in diameter. The size, weight and configuration of the working head as compared to the handle can bring undue stresses to bear on the handle, especially at the handle-to-head connection. In use, the friction of the bristles on a surface during sweeping, as well as collisions by the broom head with obstacles, place great forces on the handle and the handle-to-head connection. Furthermore, as noted above, where the handle-to-head connection is a threaded fit, the handle is apt to unscrew from the head resulting from such forces of use.

The large lateral elongation of the broom head relative to the longitudinal axis of the handle is such that forces applied at the lateral ends of the broom head act with a large moment arm on the connection of the handle and the broom head. It is therefore known to provide a brace for bracing the head-to-handle connection. The intention of such braces is to mount rigid buttressing members between points on the broom head that are laterally spaced from the handle, to one or more points on the handle that are spaced along the handle from the thread or other connection of the end of the handle and the broom head. These rigid buttressing members resist tension and compression, and thus support the broom head relative to the handle, typically perpendicularly. Whereas without such braces the center of the moment arm or the fulcrum with respect to impacts against the broom head is localized at the threaded connection, the braces provide a secondary fulcrum in addition to the existing fulcrum at the handle-to-head connection. Typically this secondary fulcrum is defined at a point on the handle a number of inches up the handle from the head.

In order to define a secondary fulcrum, it is known to provide a pair of braces for attachment to a tool such as a push broom. Each brace typically has a flange for attachment against the top of the broom head. The flanges can have holes for accepting a screw for screwing the flange of the brace to the broom head. The flanges are fixed on the broom head on opposite sides of the handle-to-head junction, equidistant from the junction. The brace has a leg portion rising from the flange and angled towards the handle. Each brace terminates in a handle connection arm disposed essentially perpendicular to the broom head. The two arms have oppositely facing circular humps that when placed in opposition, define a collar with an annular opening for frictional attachment around the handle. Nuts and bolts can be used to secure the arms about the handle, the handle depending through the annular opening and the nuts and bolts urging the annular collar tightly around the handle.

The brace as described above generally satisfies the requirement that the head be braced to the handle by members operable to resist tension and compression. However, nothing prohibits rotation of the handle within the annular opening. The handle is relatively free to unscrew from the head during use, and loosening of the threaded coupling of the handle and the broom head accelerates deterioration of the joint notwithstanding the braces.

Furthermore, such braces typically are assembled to the tool, such as a push broom, by the purchaser of the push broom. The assembly required such as fastening the flanges to the head using screws and affixing the arms about the handle using nuts and bolts presents an inconvenience to a purchaser, especially one not adept at using tools, and leaves the possibility of substantial variations in the tightness (and effectiveness) of the brace members. A purchaser faced with the inconvenience of such assembly may decide to forego attaching the brace to the tool, which accelerates the damage or destruction of the tool during regular use.

It would be desirable to provide a brace for a tool, such as a push broom, that can be quickly and easily assembled to the push broom by a purchaser of a push broom, and which is inherently effective to provide tight structural support for the broom head. Additionally, it is desirable to provide a brace for a push broom which can be attached to the push broom without substantial need for tools.

SUMMARY OF THE INVENTION

It is an object of the invention to provide an improved brace for a tool having an elongated handle and a working head extending laterally of the handle.

Another object of the invention is to provide a brace for a push broom having a handle and a broom head arranged to prevent inadvertent disconnection of the handle from the broom head by breakage or otherwise.

It is another object to provide an easily assembled brace for securing and reinforcing a broom head-to-handle connection.

These and other objects of the invention are met by a brace having a slidable collar and a pair of buttress rods. According to the invention, the brace can be used with any tool having an elongated handle and a working head residing perpendicular to the handle. The brace of the invention is particularly adapted for use with a known push broom having a handle attached to a broom head at an angle between the handle axis and a line parallel to the bristles. The broom head is typically a rectangular block of wood to which bristles are firmly secured. The handle may be threaded, frictionally fit, transversely pinned, clamped, or otherwise attached to the head at the end of the handle, but typically is threaded into a threaded socket on the broom head for receiving the broom handle.

The broom head is braced to the broom handle. The broom head is provided with holes on its top side, the holes preferably being spaced equidistantly from a center of the broom head and disposed on opposite sides of the broom head with respect to the center. The buttress members preferably are relatively thick wire rods (approx. 0.5 to 1.0 cm or $\frac{1}{4}$ to $\frac{3}{8}$" in diameter). Each buttress rod has a downward facing lower terminal part, angularly inclined relative to the major extension or leg portion of the buttress rod, the lower terminal part defining a prong for insertion into a respective hole in the broom head top. The leg portion extends at an angle relative to the longitudinal axis of the handle and relative to the lateral extension of the broom head, up from the prong and the broom head and toward the broom handle. An upper terminal part of each buttress is angled so as to lay substantially parallel to the axis of the broom handle adjacent the surface of the handle. The upper terminal part preferably extends for a length of 2.5 to 5.0cm (1–2 inches) along the broom handle.

A collar secured to the broom handle couples to the upper terminal parts of the buttress members. The collar is cylindrical and has an annular opening whereby the collar is slidable over the broom handle. The collar has a pair oppositely disposed of ears defining channels parallel to the handle axis for receiving the upper terminal part of each buttress arm. To complete installation of the brace, the collar is slid along the elongated handle and the arms of the wire buttress are inserted into the ears on opposite sides of the collar. The channels formed by the ears, and typically the collar itself, preferably are at least as long as the portion of the arms resting against the broom handle. The collar preferably is provided with a threaded bore aligned radially through the collar, perpendicular to the longitudinal axis of the handle. A thumb screw or a similar threaded member is threaded through the threaded bore into frictional contact with the handle to fix the collar in place on the handle. The wire buttresses, secured by the collar, resist tension and compression and prevent rotation of the broom head with respect to the handle to prevent disengagement of the head from the handle. Furthermore, the buttresses and collar couple forces applied to the broom head, particularly at a lateral space from the handle, to a point rearwardly on the handle from the threaded connection, effectively providing a second fulcrum on the handle located at the point of fixation of the collar to the handle and protecting the primary fulcrum at the thread from damage. The collar can be manufactured of a hard plastic or fiberglass or other material which is strong yet lightweight and easy to form.

A number of additional embodiments are contemplated. The collar can be provided without a thumb screw or the like for fixing it to the handle. For such an embodiment, it is desirable to provide an alternate device for fixing the collar in position on the handle. A suitable device is, for instance, a discontinuous ring having an annular opening slidable over the length of the elongated handle. The ring is provided with a tangentially disposed threaded socket passing through the discontinuity. A threaded member such as a thumb screw is fitted into the discontinuity and is rotated to decrease the size of the discontinuity, thereby decreasing the size of the annular opening for tightening the ring about the handle. In this manner the ring can be moved into position bearing against the collar and tightened about the handle. The tightened ring prevents the collar from sliding up the handle away from the head while the buttress rods prevent downward movement.

Additional embodiments include crossing the wire buttresses over the broom handle prior to insertion into the channels on the collar. Such an arrangement provides additional protection against rotation of the handle with respect to the broom head.

These and other embodiments and advantages of the invention will become more apparent in connection with the following description of certain embodiments of the invention disclosed as non-limiting examples. The scope of the invention is defined by the attached claims.

BRIEF DESCRIPTION OF THE DRAWINGS

There are shown in the drawings the embodiments of the invention as presently preferred. It should be understood that the invention is capable of embodiment in a number of specific arrangements in accordance with the disclosure herein, and reference should made to the appended claims rather than the discussion of exemplary embodiments to assess the scope of the invention in which exclusive rights are claimed. In the drawings.

DETAILED DESCRIPTION OF THE PREFERRED EMBODIMENTS

Although specific terms respecting shapes, directions and the like are used in the following description for the sake of clarity, these terms are intended to assist in the description of the particular structures of the invention selected for exemplary illustration, and are not intended to define or limit the scope of the invention.

Figure 1:
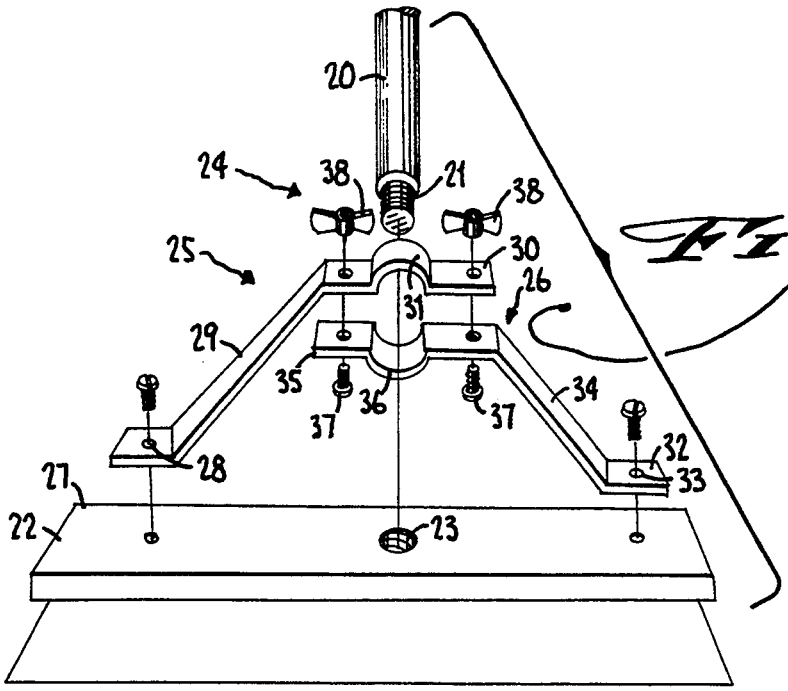
FIG. 1. (PRIOR ART)
FIG. 1 is an exploded, perspective view of a prior art brace for a push broom.

A prior art brace for bracing a push broom head to a push broom handle is shown generally in FIG. 1. In FIG. 1, the broom handle 20 is defined by a generally elongated cylindrical length of wood or the like. An end of broom handle 20 terminates in threads 21. Broom head 22 has threaded socket 23 for mating with threads 21 of broom handle 20 to securely affix handle 20 to head 22.

In order to provide additional support for the handle-to-head connection, it is desirable to provide a secondary support on the broom handle for coupling forces applied to the broom head to the handle at a point spaced along the handle from the primary fulcrum residing at the handle-to-head connection. As shown in FIG. 1, a secondary support according to the prior art is provided by brace 24 having a pair of brace sections 25 and 26. Brace section 25 has flange 27 adapted to lay flat on a top surface of broom head 22. Flange 27 is provided hole 28 whereby brace section 25 can be fixed, for example by a screw 28 to broom head 22.

Brace section 25 has leg 29 depending from flange 27 and rising up from broom head 22 towards handle 20. Leg 29 terminates in arm 30, essentially disposed parallel to broom head 22. Arm 30 has semicircular hump 31 for fitting against a front side of cylindrical handle 20. Brace section 26 has flange 32 having hole 33 for fixation to head 22 using a screw or other threaded member. Brace section 26 also has leg 34 and arm 35. Arm 35 has semicircular hump 36 for encompassing a back half of handle 20. Matching arm 30 having hump 31 across a front half of handle 20 with arm 35 having hump 36 across a back half of handle 20 provides an annular collar for grasping handle 20 at a point above the handle-to-head connection. Brace sections 25 and 26 preferably are secured together about handle 20 using bolts 37 and wing nuts 38.

The prior art device as shown in FIG. 1 is ineffective to prevent rotation of handle 20 with respect to the collar formed by humps 31 and 36. It is therefore possible for handle 20 to unscrew from threaded socket 23 and become disengaged from broom head 22. Moreover, the brace of FIG. 1 is relatively difficult to assemble, for example, requiring tools to screw down flanges 27 and 32 to broom head 22 as well as requiring effort to securely fasten wing nuts 38 and bolts 37.

Figure 2:
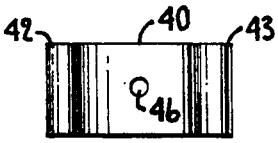
FIG. 2 is an elevated front view of the collar component of the invention.
Figure 3:
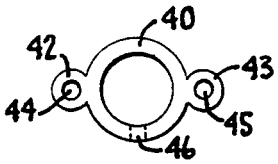
FIG. 3 is a top view of the collar component of the invention.
Figure 4:
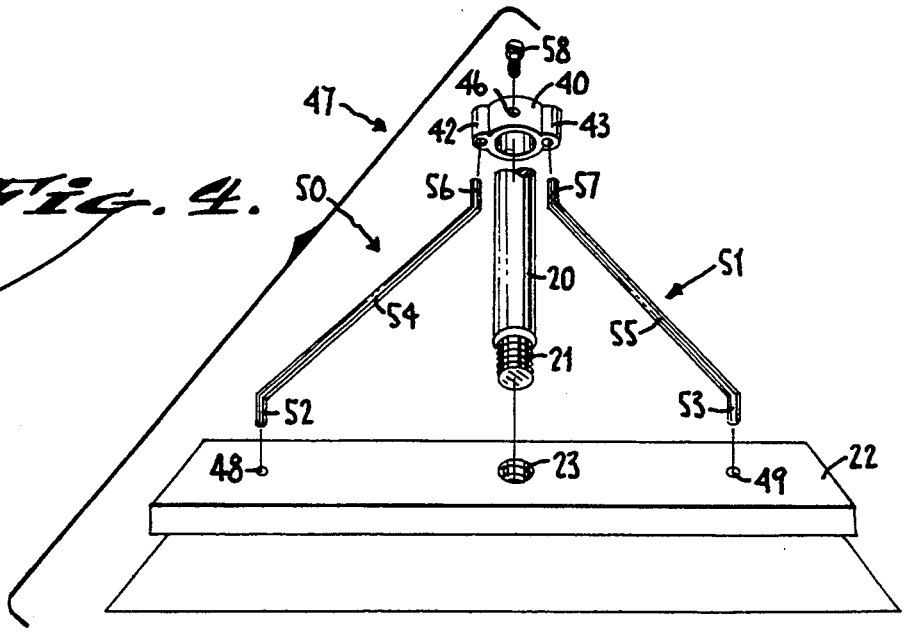
FIG. 4 is an exploded, perspective view of the brace of the invention.

In order to overcome the disadvantages imposed by the prior art, an improved broom head bracing structure according to the invention is shown in FIGS. 2, 3 and 4. FIGS. 2 and 3 depict collar 40 of the invention. Collar 40 is preferably constructed of a hard plastic, fiberglass or other easily molded, lightweight yet strong, durable material. Collar 40 defines annular opening 80 for through passage of handle 20. Collar 40 preferably is relatively easily slidable over handle 20 and is provided with means for affixing the collar at an axial point on the handle.

Collar 40 has a pair of ears 42 and 43 disposed on opposite sides of the handle. Ears 42 and 43 define channels 44 and 45. Collar 40 is also provided with radially disposed threaded bore hole 46. To attach brace 47 of the invention to a broom handle 20 or the like, broom head 22 is provided with prong holders 48 and 49. Prong holders 48 and 49 can be through holes or blind bores formed in a top surface of broom head 22. The holes can be bored by an end user of the broom during the brace assembly process but are more preferably drilled into the broom head during manufacture of the broom head prior to sale to an end user.

Buttress rods 50 and 51 couple between the prong holders 48, 49 and the ears 42, 43 of the collar 40. Each buttress rod has a lower prong 52 and 53 respectively, for insertion into a respective one of prong holder 48 and 49. Prong holders 48 and 49 preferably are sufficiently deep to accept the entire length of prongs 52 and 53.

Buttress rods 50 and 51 have connecting members 54 and 55, extending upwards on the opposite from prongs 52 and 53 and broom head 22. The connecting members are angled inwardly toward broom handle 20. Each of buttress rods 50 and 51 terminates in an upper prong 56, 57. In the embodiment shown, the upper prongs are angled relative to the connecting members to be essentially parallel to the longitudinal axis of handle 20. Upper prongs 56 and 57 lay flat adjacent the exterior circumference of handle 20 on opposites sides of handle 20.

After insertion of lower prongs 52 and 53 into prong sockets 48 and 49 respectively, buttress rods 50 and 51 are arranged whereby the upper prongs 56 and 57 lay flat against opposite sides of handle 20. Collar 40 is slid along handle 20, e.g. down the length of handle 20 from the user end, until upper prongs 56, 57 of buttress rods 50, 51 engage in the collar 40. Upper prongs 56, 57 are inserted into channels 44 and 45 respectively. Downward force on collar 40 ensures that upper prongs 56 and 57 are fully inserted into channels 44 and 45 and that lower prongs 52, 53 are well seated in prong receptacles 48, 49 in the broom head 22. To complete the assembly of brace 47, thumb screw 58 or some other threaded member is screwed through threaded bore hole 46 until the thumb screw 58 tightly contacts the outer circumference of handle 20 for fixing collar 40 in place axially on handle 20, while also preventing relative rotation of the handle 20 and collar 40. It is possible to provide threaded member 58 with a point for penetrating handle 20 to more securely fasten collar 40 in place on handle 20.

As can be seen from the above description of the preferred embodiments of the invention, brace 47 can be quickly and easily assembled by an ordinary end user of the push broom without a need for tools or special skills. Furthermore, the three piece construction of the brace allows for the brace to be broken down to its component parts presenting a relatively compact package during shipment and sale for assembly by an end user. The relatively small size and light weight of the brace components do not interfere with or add extra burden or costs to shipping the brace with the push broom. However, brace 47 and collar 40 combine to adequately provide a second fulcrum disposed on broom handle 20 at a point above the point of attachment of the broom handle to the broom head. The addition of a second fulcrum provides added support to broom head 22 and prevents breakage or disengagement of handle 20 from broom head 22. Furthermore, since thumb screw 58 firmly presses against or penetrates handle 20, rotation of collar 40 with respect to handle 20 is prohibited. Since collar 40 is non-rotatably fixed in place on handle 20, buttress rods 50 and 51 prevent rotation of broom head 22 with respect to handle 20, thereby preventing disengagement of broom head 22 from handle 20.

Figure 5:
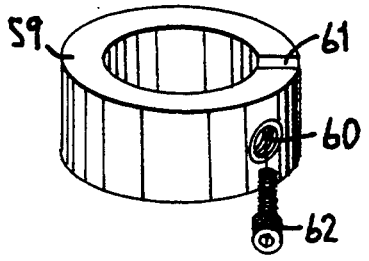
FIG. 5 is a perspective view of the ring component used in an alternate embodiment of the invention.
Figure 6:
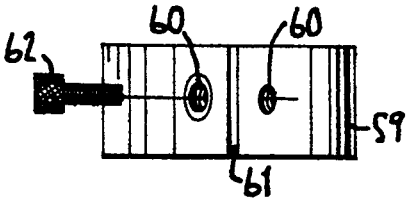
FIG. 6 is an elevated plan view of the ring.
Figure 7:
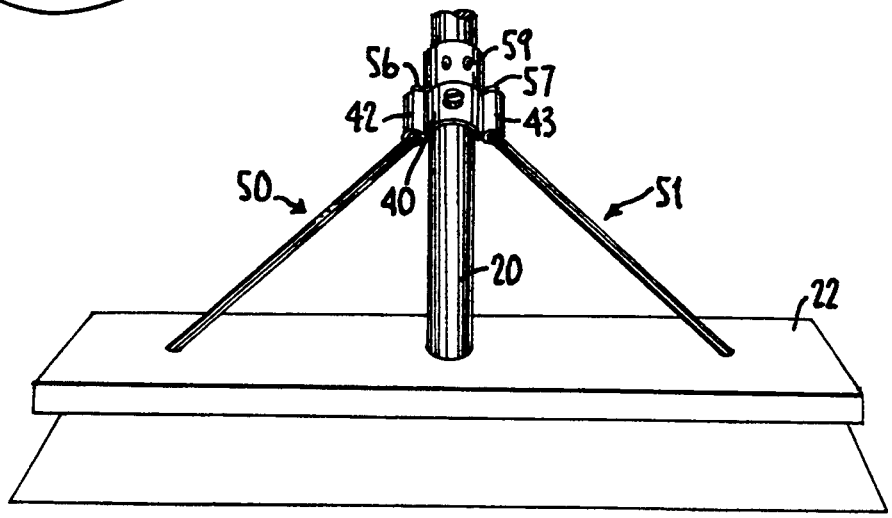
FIG. 7 is a perspective view of an alternate embodiment of the invention using the ring.

FIGS. 5, 6 and 7 depict alternative embodiments of the invention. FIGS. 5 and 6 depict annular ring 59 having threaded bore hole 60 disposed tangentially through ring 59. Ring 59 is discontinuous, thereby defining gap 61. Bore hole 60 is evenly aligned on each side of gap 61. The annular interior diameter of ring 59 nominally is greater than an outer diameter of broom handle 20 (not shown in FIGS. 5 and 6). However, ring 59 has bolt 62 or some other threaded member adapted to be screwed into threaded bore 60. Tightening bolt 62 into bore hole 60 decreases the size of gap 61, thereby decreasing the annular inner diameter of ring 59. In this manner, ring 59 can be tightened around handle 20 to obtain a tight and non-rotatable fit.

In use, therefore, buttress rods 50 and 51 are assembled to a broom head 22 as described above. However, as shown in FIG. 7, ring 59 is brought into position bearing against collar 40. Ring 59 preferably is constructed of the same hard plastic or fiberglass used to construct collar 40.

Ring 59 can be used where collar 40 is not provided with a threaded bore hole 46 or thumb screw 58 to fix collar 40 in position on handle 20. In the alternative, ring 59 can be used in conjunction with a collar fixable to handle 20 to further secure the collar in place on handle 20. Bolt 62 preferably has a relatively large head having a ridge pattern for easy grasping for manual tightening of bolt 62. Additionally, the head of bolt 62 can be provided with a pentagonal, hexagonal or similarly shaped recess for acceptance of an Allen wrench or the like to provided added torque to bolt 62 to close gap 61 in discontinuous ring 59.

Figure 8:
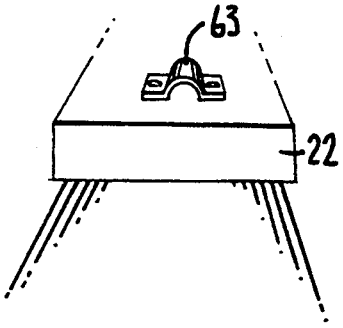
FIG. 8 is an elevated side view of an alternate method of fixing the buttressing rod of the invention to a broom head.

Preferably, lower prongs 52 and 53 are disposed perpendicular to the plane of broom head 22 and are inserted into prong holders 48 and 49, oriented perpendicular to the plane of the broom head. However, it is also within the scope of the invention to arrange the prongs parallel to the plane of the broom head, or at an angle whereby the prongs are aligned to the major extension of buttress members 50, 51. Where the lower prongs 52, 53 are parallel to the plane of the broom head, they can be received in prong straps 63 as shown in FIG. 8, for fastening the buttress members 50, 51 to broom head 22.

Figure 9:
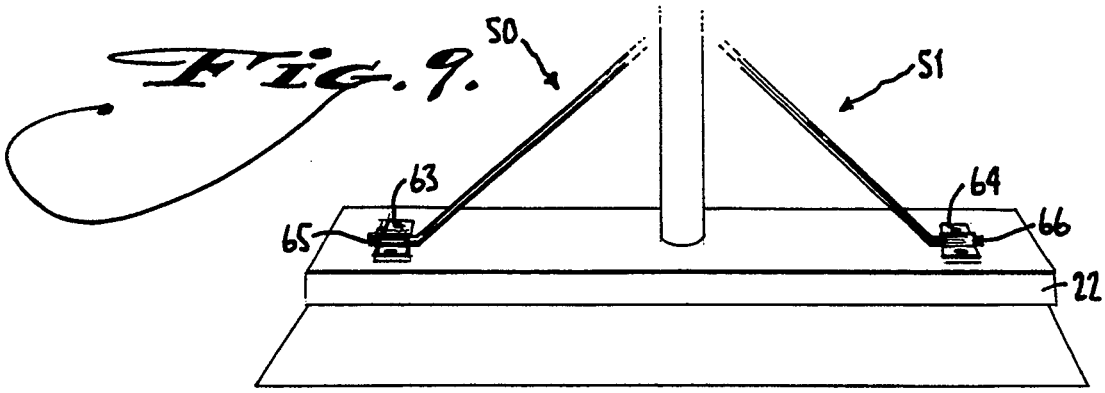
FIG. 9 is a perspective view showing the attachment means of FIG. 8 securing the buttressing rods to the broom head.

In FIG. 9, buttress rods 50 and 51 are provided with lateral lower prongs 65 and 66, extending parallel to a longitudinal axis of broom head 22 when buttress rods 50 and 51 are installed. Lateral prongs 65 and 66 are adapted to lie essentially flat against a top surface of broom head 22. Prong strap 63 and 64 are fixed over lateral prongs 65 and 66, respectively, to secure buttress rods 50 and 51 to broom head 22.

Figure 10:
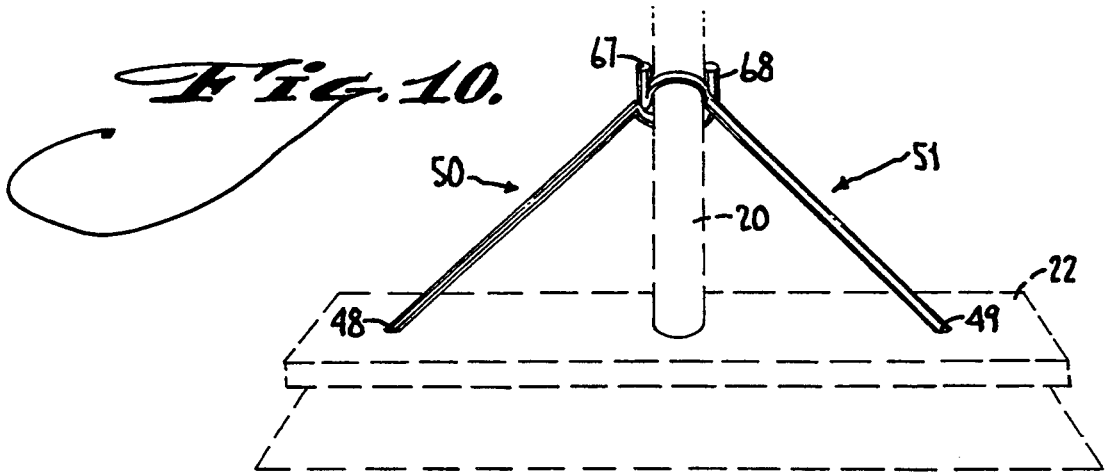
FIG. 10 is a perspective view of an alternate embodiment of the invention herein the buttressing rods cross over the broom handle.

A further embodiment of the invention is shown in FIGURE 10. FIG. 10 has broom head 22 and broom handle 20. However, as shown in FIG. 10, buttress rod 50 and 51 have arms 67 and 68 adapted to cross over handle 20 before insertion in a channel disposed on an opposite side of the broom handle. In order to accomplish this, each buttress rod is provided with a semicircular bend in its arm 67, 68 allowing the arm to follow the contour of handle 20 when arms 67 and 68 are placed against handle 20. As shown in FIG. 10, arm 68 of buttress rod 50 is curved allowing it to bend around the back side of handle 20. Arm 67 of buttress rod 51 has a curve allowing it to wrap around the contour of the front of handle 20. The embodiment depicted in FIG. 10, having arms 67 and 68 crossed over handle 20, also provides resistance to rotation of broom head 22 with respect to handle 20.

Figure 11:
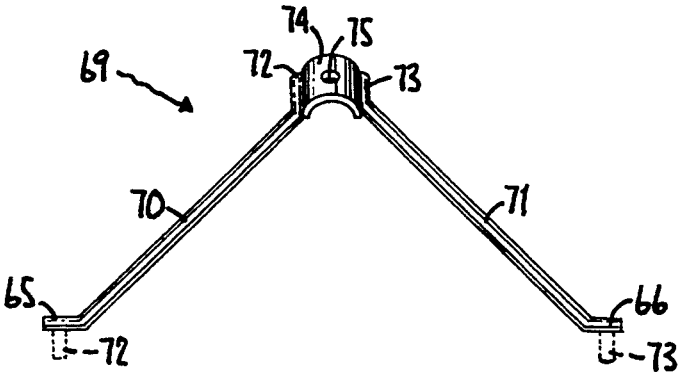
FIG. 11 is another embodiment of a brace in accordance with the invention.

Another embodiment of the invention is depicted in FIG. 11. In FIG. 11, brace 69 is a one-piece unit. Brace 69 has angled legs 70 and 71. Each of angled legs 70 and 71 terminates in a lateral prong 65 and 66. In this manner, brace 69 can be fastened to a top of broom head 22 (not shown) using prong straps 63 and 64 (not shown). Alternatively, brace 69 can be provided with prongs 72 and 73 for insertion into a respective one of a prong socket (not shown).

An opposite end of angled legs 70 and 71 terminates in strap arm 72 and 73. Strap arms 72 and 73 are fixed, such as by welding or crimping to semicircular strap 74. Strap 74 is semicircular in shape to follow the contours of cylindrical handle 20 (not shown). Strap 74 is provided with hole 75 whereby strap 74 can be tightly fastened against handle 20 using, for example, a wood screw. Although the device of FIG. 11 is less convenient in terms of shipping and assembly as compared to other embodiments of the invention, the device of FIG. 11 accomplishes the objectives of bracing a broom head to a handle and preventing disengagement of the head from the handle.

Insofar as the respective embodiments use upper and lower prongs 56, 57, 52, 53, 65, 66 that are angled relative to the primary extension of the buttress members 50, 51 (i.e., angled relative to legs 54, 55), the buttress members function in tension and compression to resist lateral displacement of the axis of handle 20 relative to its nominal position perpendicular to the lateral extension of the broom head. This occurs because the angled prongs can be neither pulled from nor pushed further into their respective receptacles 48, 49, 44, 45 due to the angle of the prongs relative to the direction of tension or compression. Accordingly, the angled prongs provide good support for the broom head and handle. It is also possible, however, to use the buttress members only to resist compression, for example using a buttress member 50, 51 that is straight, or angled only at one of its upper and lower ends to form a prong. The corresponding receptacle (e.g., bore 48 or 49) is then formed as a blind bore rather than a through hole, and is angled to complement the direction of the buttress member. Each of the opposite buttress members resists compression, but in tension would be pulled from bore 48 or 49, but for the anti-compression function of the buttress member on the opposite side. FIGS. 7 and 10 illustrate the use of angled bores in the broom head.

The invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to assess the scope of the invention in which exclusive rights are claimed.

What we claim is:

1. A brace attached to a tool having an elongated handle and a working head extending laterally at an end of the handle, said brace comprising:

a slidable collar, said collar adapted for sliding along the elongated handle, said collar having two opposing channels;

fixing means fixing said collar in place on said handle;

a buttress structure comprising two rods, each rod having a handle end, a head end, and a leg section between said handle end and said head end, each of said handle ends being angularly offset from its respective leg section and inserted within a respective one of said opposing channels of said collar, and each of said head ends including a prong; and two prong holders on the tool head disposed on opposite sides from a point on the tool head, each of said prongs being inserted within a respective prong holder, the fixing means and buttress thereby bracing the working head to the handle, said rods being prevented from moving in an axial direction relative to the handle by said collar and said tool head.

2. The brace of claim 1, wherein said point on the tool head is the center and wherein the prong holders are equally spaced from the point.

3. The brace of claim 1, wherein said fixing means comprises a threaded member radially disposed through said collar and tightenable into contact with said handle for fixing said collar in place on said handle.

4. The brace of claim 3, wherein said threaded member penetrates an exterior of the handle when screwed in for fixing said collar to said handle.

5. The brace of claim 1, wherein said fixing means is a slidable ring having tightening means, said ring being brought to bear against said collar to secure said collar in place on said handle.

6. The brace of claim 5, wherein said slidable ring is discontinuous and said fastening means is a threaded member for reducing a gap in the ring to tighten the ring about the handle.

7. The brace of claim 1, wherein said tool is a push broom.

8. The brace of claim 1, wherein a first of said channels and a first of said prong holders are disposed on one side of said handle, a second of said channels and a second of said prong holders are disposed on an opposite side of said handle, the handle end of the rod engaged in said first prong holder being inserted within said second channel, and the handle end of the rod engaged in said second prong holder being inserted in said first channel.

9. The brace of claim 1, wherein said prong holders comprise sockets disposed in the working head.

10. The brace of claim 1, wherein said prong holders comprise semi-circular straps attached to said broom head for securing said lower prongs against the head.

* * * * *